US007628390B2

(12) United States Patent
Stauber

(10) Patent No.: US 7,628,390 B2
(45) Date of Patent: Dec. 8, 2009

(54) INSTALLATION AND METHOD FOR THE LIFTING OF FOLDED PRINTED PRODUCTS FROM A CONVEYOR

(75) Inventor: H. Ulrich Stauber, Grut (CH)

(73) Assignee: Ferag AG, Hinwil (CH)

( * ) Notice: Subject to any disclaimer, the term of this patent is extended or adjusted under 35 U.S.C. 154(b) by 425 days.

(21) Appl. No.: 11/561,637

(22) Filed: Nov. 20, 2006

(65) Prior Publication Data

US 2007/0114710 A1 May 24, 2007

(30) Foreign Application Priority Data

Nov. 23, 2005 (CH) ..... 1865/05

(51) Int. Cl.
*B65H 37/04* (2006.01)

(52) U.S. Cl. ..... 270/52.26; 270/32; 270/37; 270/52.14; 270/52.16; 270/52.27; 270/52.28; 270/52.29

(58) Field of Classification Search ..... 270/32, 270/37, 52.14, 52.16, 52.26, 52.27, 52.28, 270/52.29

See application file for complete search history.

(56) References Cited

U.S. PATENT DOCUMENTS 4,236,706 A * 12/1980 Schlough ..... 270/52.18
4,260,145 A * 4/1981 Mebus et al. ..... 270/52.14
4,614,290 A * 9/1986 Boss ..... 227/1
2003/0161705 A1 8/2003 Trovinger

FOREIGN PATENT DOCUMENTS

| | | |
|---|---|---|
| CH | 683767 | 5/1994 |
| EP | 0202507 | 11/1986 |
| EP | 0218804 | 11/2006 |

* cited by examiner

*Primary Examiner*—Gene Crawford
*Assistant Examiner*—Leslie A Nicholson, III
(74) *Attorney, Agent, or Firm*—Rankin, Hill & Clark LLP

(57) ABSTRACT

In an installation and a method for the lifting of folded printed products (1) from a conveyor, wherein the printed products (1) are transported straddled across a saddle (2), the saddle (2) includes a counter tool (4) for processing of printed products (1) straddled across the saddle (2). Therein a means of lifting (5) extends alongside and parallel to the saddle (2) and is staggered at right angles to a support shoulder (3)of the saddle (2) as well as to the counter tool. As the means of lifting, the support shoulder (3) and in particular the counter tools are not situated in line but staggered, an unrestricted positioning of binding points along the support shoulder (3) is possible. There is no need to consider the position of lifting tappets or levers for the lifting of the printed products in the support shoulder (3).

14 Claims, 3 Drawing Sheets

INSTALLATION AND METHOD FOR THE LIFTING OF FOLDED PRINTED PRODUCTS FROM A CONVEYOR

BACKGROUND OF THE INVENTION

1. Field of the Invention

The invention concerns an installation and a method for the lifting of folded printed products from a conveyor.

2. Description of Related Art

CH 683 767 A5 reveals a method for the withdrawal of bound and folded printed products from the supports of a gatherer-stitcher. Therein, the printed products are conveyed upon a saddle-shaped, lightly built support to a binding device. The supports comprise a ridge-like support shoulder supporting the folded printed products. The support shoulders comprise on one hand recesses for bending installations that can be pushed against the support shoulders from below, and on the other recesses for ejection tappets. For the binding procedure, a binder wheel conveys the supports and a bending installation is conducted through the appropriate recess of the support into the binding position. Subsequently, the printed product is lifted from the support shoulder by the ejection tappets pushing through further recesses in the support shoulder and can be extracted e.g. by grippers. Consequently, the lifting tappets and the bending installation, viewed alongside the support shoulder, must be situated in different places. Therefore the possibilities for the positioning of the binding locations and the gripping points are limited.

EP 0 202 507 A3 demonstrates thin rod-shaped supports, across which the printed products are hung. For binding purposes a bending installation or anvil is conducted from below toward the supports and lifts the printed products from the support. The printed products now lie upon the bending installation and are stapled or stitched. Subsequently the bending installation is retracted and the printed products are deposited upon the supports. In order to remove the printed products a blade is conducted past the thin support from below, so that the printed products are lifted and gripped by a pair of rollers.

In the EP 0 218 804 A1 folded printed products are lifted in a collective conveyor of a gathering drum. The collective conveyor comprises a carrier ledge forming a ridge and equipped with metal prop sheets on either side. The printed product lies with the fold on top of the carrier ledge and the metal prop sheets. In order to remove the printed products, lifting pins are swivelled through slots in the carrier ledge, so that the printed products are lifted as well as conveyed along the carrier ledge. In this elevated condition additional clamping tools can slide under the raised printed product, lift it from the collective conveyor and take it away.

BRIEF SUMMARY OF THE INVENTION

It is, thus, the object of the invention to create an installation and a method for the lifting of folded printed products from a conveyor of the kind mentioned at the beginning, which remedies the disadvantages mentioned above.

This object is achieved by an installation and a method for the lifting of folded printed products from a conveyor with the properties of the corresponding independent claims.

In the installation for the lifting of folded printed products from a conveyor, in which conveyor the printed products are transported straddling across a saddle, the saddle thus comprises a counter tool for the processing of the printed products straddled across the saddle. Therein, a means of lifting extends alongside and parallel to the saddle and the means of lifting is situated at right angles to a support shoulder of the saddle and staggered in relation to the counter tool.

As the means of lifting are not situated in line but in a staggered fashion regarding the support shoulder and in relation to the counter tools in particular, an arbitrary positioning of binding points along the support shoulder is possible. There is no need to consider the position of ejection plungers or of levers for the lifting of printed products in the support shoulder.

It is therefore also possible that the support shoulder extends along the entire length of the saddle without recesses for a means of lifting. The term "length" of the saddle relates here and in the following to the direction of the furthest expansion of the support shoulder, i.e. the direction parallel to the fold of the printed product. The transverse direction of the support shoulder runs vertically to that. This transverse direction is in turn parallel to a longitudinal or conveying direction of a collective system conveying the saddles. It is further possible that the support shoulder extends along the entire length of the saddle without any recesses whatsoever. Accordingly the saddle can be of a slim and yet solid and stable design.

It is further possible that the counter tool, for example, a bending device for a binding installation, is flexibly mounted or firmly connected to the support shoulder, or even fashioned in a single unit as part of the support shoulder. Consequently several bending devices can be situated along the support shoulder, which can then also be referred to as a girder.

In a preferred embodiment of the invention, an upper edge of the means of lifting extends parallel to the support shoulder for the entire length of the upper edge. As the means of lifting is lifted, the inside of the fold therefore lies on the upper edge for the entire length.

In another preferred embodiment of the invention an upper edge of the means of lifting extends in some first regions parallel to the support shoulder, wherein the printed product is supported while being lifted by these first ranges. In at least one second region, the upper edge comprises an offset or a recess or a depression in relation to the first region. This allows for the printed product to be gripped in the region of this offset by a means of clamping. For example, the printed product can be gripped and discharged by a gripper. Alternatively, it is also possible in this region to control the lifted printed product with a means of clamping furnished as a thickness gauge. This thickness gauging can also be combined with the gripper, i.e. the gripper can transport the printed product as well as measure its thickness.

In case the thickness of the printed product falls below a given nominal thickness, it can be deduced that the printed product is incomplete. In this case, in a preferred embodiment of the invention, the printed product is not cleared but is lowered back on to the support shoulder by the lifting device and remains in the gathering installation for fault correction.

In another preferred embodiment of the invention the means of lifting is a flat plate, for example, a metal sheet. In a lower position the metal sheet hugs a flank of the saddle, so that the contour of the saddle is not substantially altered by the adjacent metal sheet. The metal sheet is parallel movable in a sliding guide and is shifted parallel into an upper position for the lifting of the printed products. Therein an upper edge of the metal sheet moves away from the saddle and the printed product lies on top of this upper edge. The offset of the upper edge mentioned above is advantageously formed by a recess or indentation in the upper region of the plate.

In another preferred embodiment of the invention, the means of lifting is a wire frame. Therein the wire frame is conducted at both longitudinal ends of the saddle in a parallel guide allowing a parallel shift vertically to the longitudinal direction of the support shoulder. In the middle region along the saddle the wire frame runs either completely parallel to the support shoulder or is staggered in at least one area as explained above.

Alternatively, the means of lifting can be a flat plate with its upper edge pushing into the fold of the printed products from inside. This plate too can, in line with the offset of the upper edge, comprise a gap, the position of which along the support shoulder corresponds with the position of a gripper or thickness gauge.

In principle it is also possible that the installation comprises two means of lifting. In this case the first means of lifting is positioned on a leading side of the saddle and the second means of lifting on a trailing side of the saddle (with regard to the conveying direction and the transverse direction of the support shoulder, respectively). Thus, it is possible to lift the printed products at various points in a gathering system, wherein each variously positioned means of clamping can grip the printed product at these various points along the support shoulder. To this end the upper edges of both means of lifting are advantageously of different shapes and comprise in particular one or several points with an offset in various regions along the support shoulder.

The named method for the lifting of folded printed products from a conveyor including the following steps:

Gathering and/or transporting a printed product upon the support shoulder of the saddle, lifting the printed product from the support shoulder by the means of lifting and gripping the printed product by a means of clamping; and/or Gathering and/or transporting the printed product upon the means of lifting in an elevated condition, lowering the printed product on to the support shoulder and stitching or stapling the printed products.

Thus, the printed product can be gathered or just conveyed upon the support shoulder or upon the lifting device in the upper position. Depending on which operation is followed, the lifting device is moved into the appropriate position as required, i.e. down for binding or up for gripping. In principal these operations such as gathering, binding, gripping (incl. measurement) can be performed in any chosen order. The lifting device(s) therein enable the printed product to be brought into varying positions where the various tools can be activated. Certain operations demand a particular position of the lifting device while other operations, in particular the gathering, are in principle possible in any position of the lifting device.

If the means of clamping is a gripper, then the method advantageously comprises as a further step the discharge of the printed product by the gripper. If the means of clamping is a thickness gauge the method comprises as further steps:

Measuring a thickness of the printed product by the thickness gauge; and optionally Lowering the printed product on to the support shoulder by lowering the means of lifting.

Further preferred embodiments transpire from the independent claims. Therein the properties of the method claims may be appropriately combined with the installation claims and vice versa.

BRIEF DESCRIPTION OF THE DRAWINGS

In the following the object of the invention is explained in more detail on the basis of preferred embodiments illustrated in the enclosed drawings.

Figure 1:
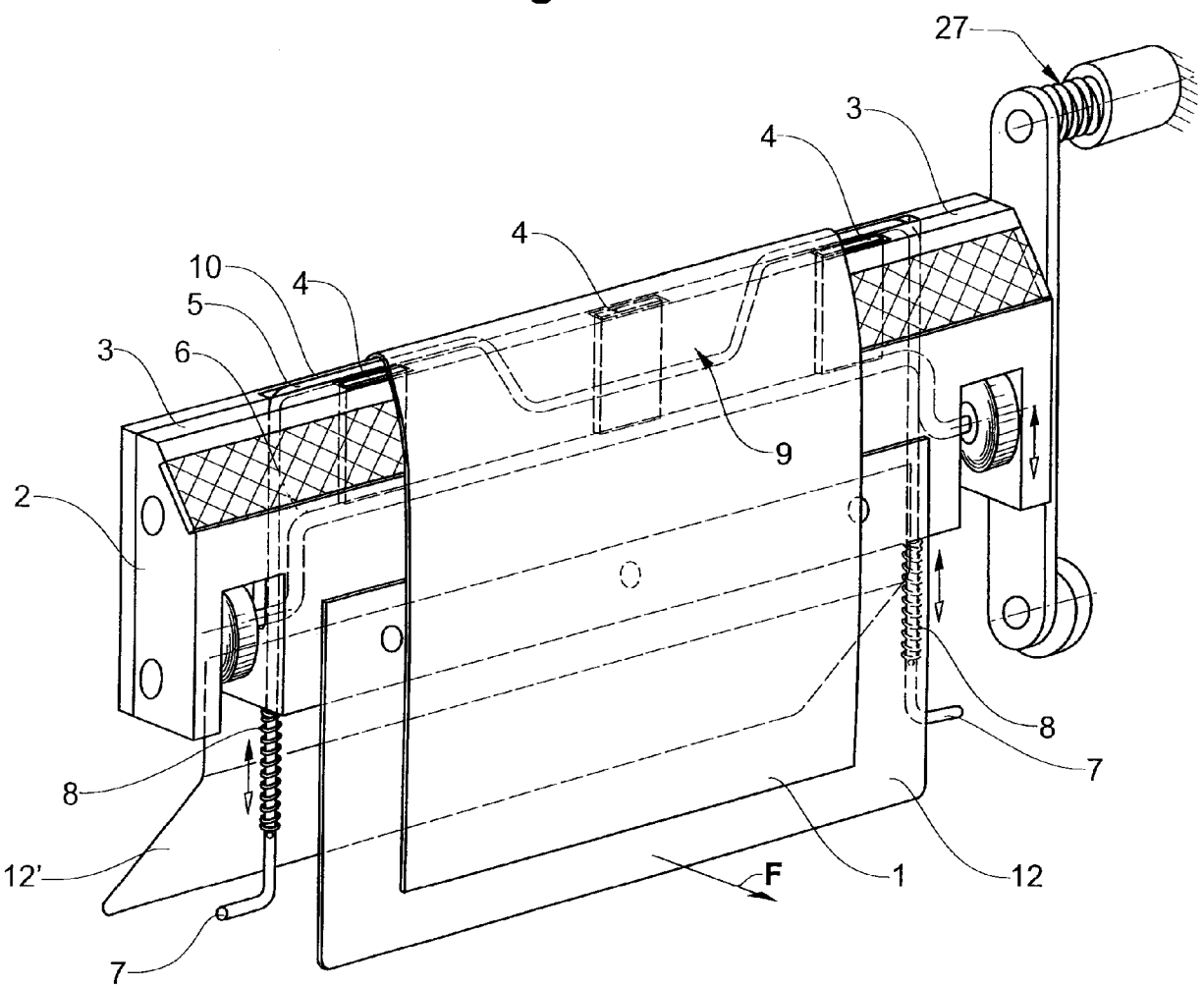
FIGS. 1 and 2 show in perspective view a saddle with a wire frame as a lifting device in a lower and in an upper position.

The reference symbols used in the drawings and their meaning are listed summarily in the index of reference symbols.

DETAILED DESCRIPTION OF THE INVENTION

FIG. 1 shows schematically a perspective view of a saddle 2 for the conveyance of a printed product 1. The printed product 1 is folded and placed with the fold or spine across a support shoulder 3 of the saddle 2. The support shoulder 3 comprises one or several counter tools such as benders 4 for a binding device. The benders 4 can be designed as passive or active, i.e. mobile themselves.

Due to the forces as occur during stitching or stapling, the benders 4 and the saddle 2 must accordingly be of a solid and stable construction. This is in contrast to saddles 2, which are intended for conveyance only and therefore of light and thin construction. In the case of such light saddles 2, according to the state-of-the-art, a bending installation is moved into a binding position by a bind wheel for binding purposes.

On at least one side of the support shoulder 3, a lifting device 5 is situated. The lifting device 5 extends along the longitudinal direction of the saddle 2 and the support shoulder 3, thus essentially parallel to these. In a transverse direction of the saddle 2 (i.e. vertically to the named longitudinal direction) the lifting device 5 is in a staggered position in relation to the support shoulder 3. In the case of a gathering system gathering along a straight line, this transverse direction of the saddle 2 usually corresponds with the conveying F of the printed products 1. The lifting device 5 can be situated in the transverse or conveying direction F in front of or behind the support shoulder 3. In front of and behind the support shoulder 3, sheets 12, 12' of spring steel extend essentially downward from the saddle 2. A printed product 1 placed on the support shoulder 3 touches the steel sheets 12, 12'. The lifting device(s) 5 are positioned on the inside of one of the steel sheets 12, 12' but on the outside of the support shoulder 3, i.e. between the saddle 2 and one of the steel sheets 12, 12'. The saddle 2 is suspended in a conveyor track by supports 27 and is conveyed upon a rotating conveyor track through the gathering system by elements not indicated, such as e.g. a chain.

Figure 2:
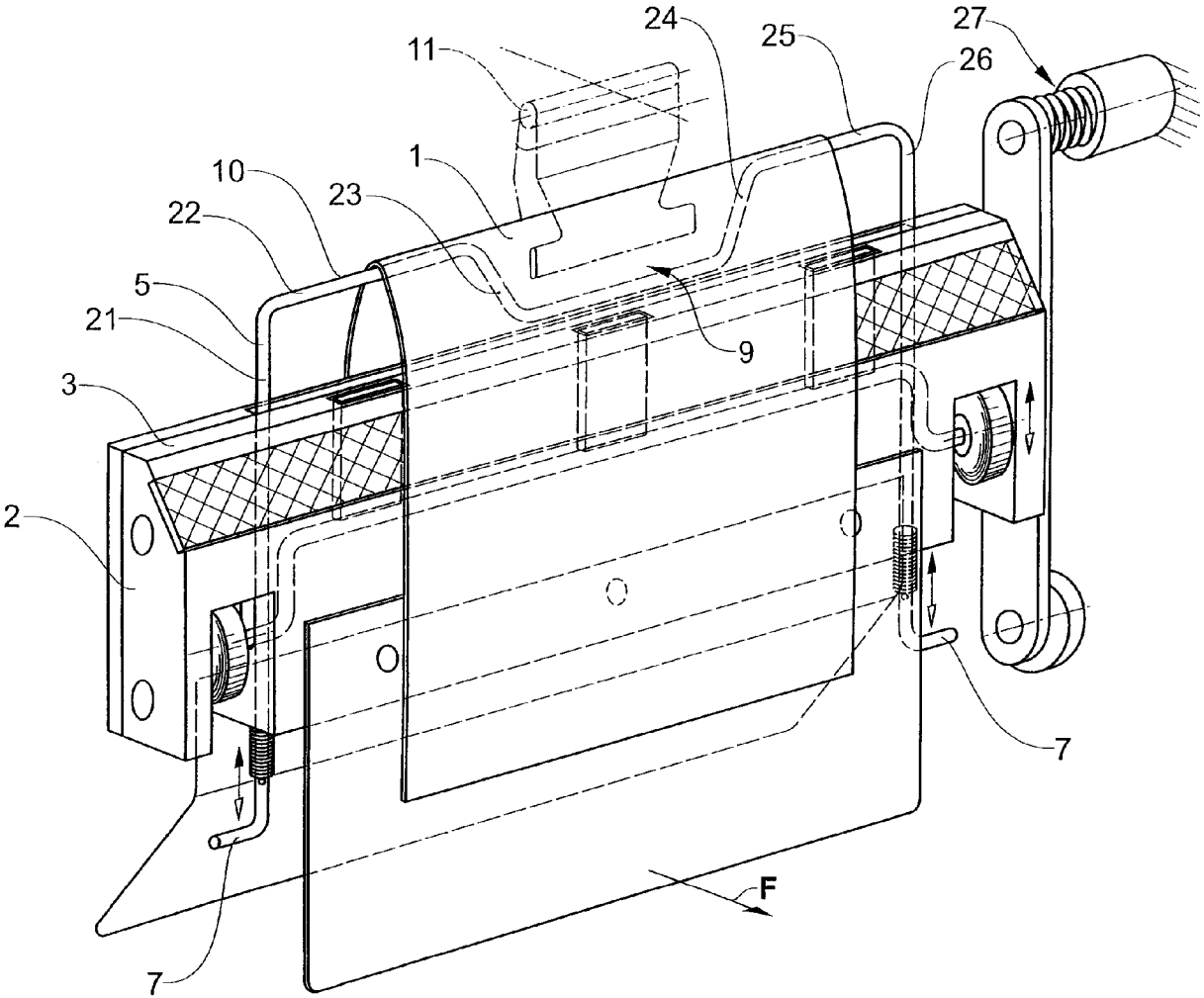

In FIG. 1 the lifting device 5 is illustrated in a lower, inactive or basic position, in FIG. 2 the lifting device 5 is illustrated in an upper, active or elevated position. In the elevated position a gripper 11 is indicated by chain line.

A frame end 7 serves as a control element by shifting the lifting device 5 as required against the force of a resetting spring 8 through a control cam at the conveyor track. Therein the lifting device 5 is moved essentially parallel through a parallel guide 6. Of course the lifting device 5 can also be moved in other ways.

In a preferred embodiment of the invention, the lifting device 5 is made of a firm wire and comprises at least one offset 9 of the upper edge 10. The upper edge 10 comprises first not staggered regions 22, 25 pushing the fold of the printed product 1 upwards from inside as the printed product 1 is being lifted. In the region of the staggering 9 from the first regions the elevated printed product 1 can be gripped and discharged by a gripper 11, or the thickness of the printed product 1 can be measured without the lifting device 5 influencing the gauging.

The wire frame advantageously comprises: a first section 21 and a sixth section 26, each extending vertically to the support shoulder 3 and each sliding in an allocated parallel guide 6, 6', a second section 22 and a fifth section 25, each running parallel to the support shoulder 3 and situated in collinear relation to each other, a staggered section 9 running parallel to the support shoulder 3 and staggered from the second section 22 and fifth section 25, and a third section 23 between the second section 22 and the staggered section 9 as well as a forth section 24 between the staggered section 9 and the fifth section 25.

If a plate is used instead of the wire frame, the upper edge 10 of the plate can comprise sections extending in the same manner as the named sections of the wire frame.

Figure 3:
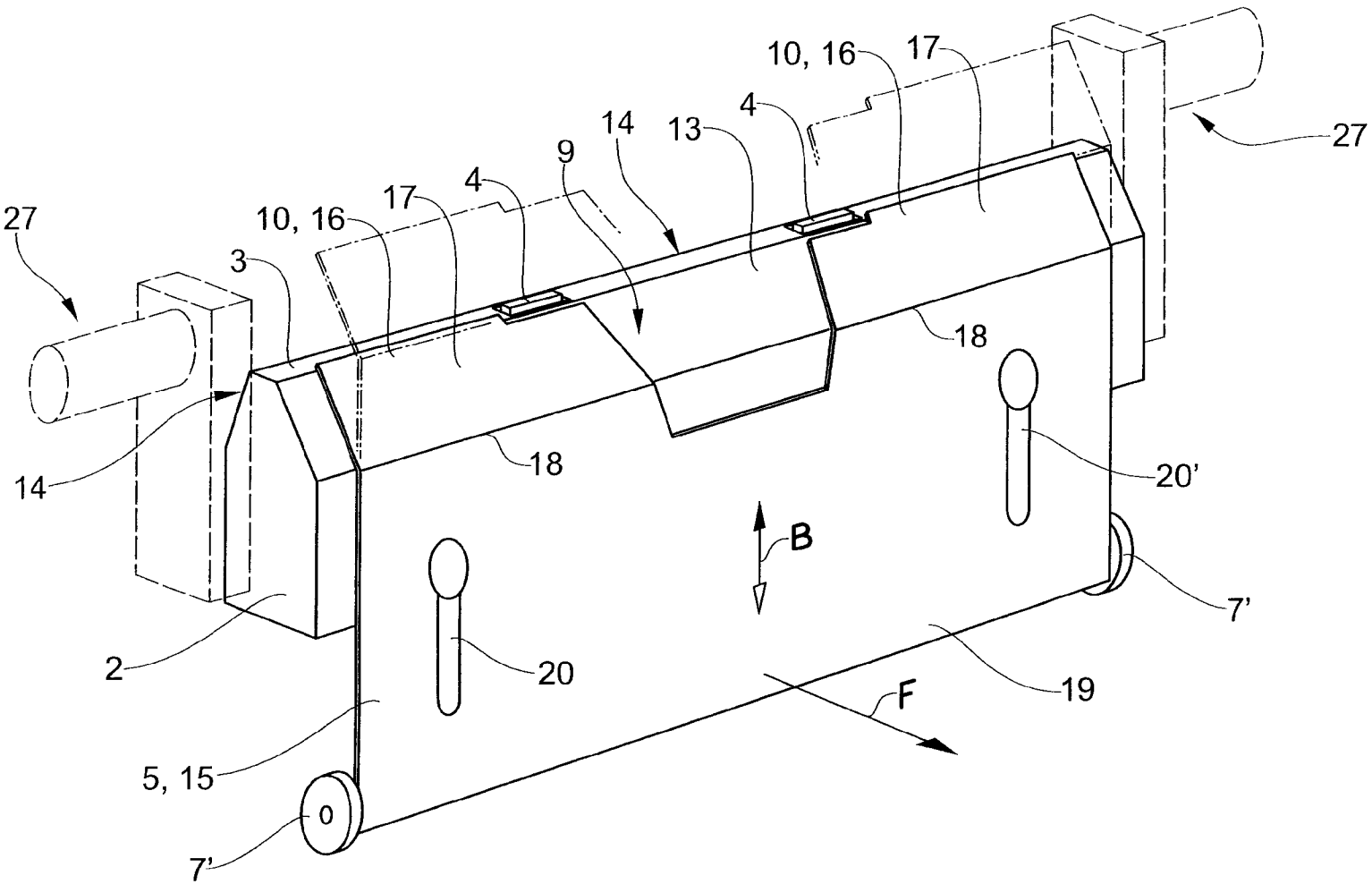
FIG. 3 shows a view with a metal sheet as a lifting device.

FIG. 3 shows a relevant embodiment of the invention with a metal sheet 15 as a lifting device 5. In favor of simplicity, only the essential elements of the saddle 2 and of the benders 4 are indicated. The support 27 of the saddle 2 is indicated by chain line. The metal sheet 15 is shaped according to the shape of the leading side of the saddle 2 in conveying direction F. In particular, a support section 16 of the metal sheet 15 hugs, in its lower position, a leading support flank 13 of the support shoulder 3. In principle, a lifting device 5 could be alternatively or additionally situated at the trailing support flank 14. Even several lifting plates 5 could be situated on the same side of the saddle 2 and ,for example, with the same parallel guide.

The lifting device(s) 5 are fixed to the saddle 2 by a parallel guide 20, 20', in particular by a slide way, and can be moved in a moving direction B between a lower adjacent position and an upper lifting position. The motion is triggered, for example, by a control element such as a roller 7' via a control cam.

The metal sheet 15 comprises a main surface 19, which is essentially even and with its surface forms a part of the parallel guide 20 as the metal sheet 15 glides along the saddle 2. The control wheels 7' are fixed to the lower part of the main surface 19. At the upper part of the main surface 19 a support surface 17 of the metal sheet 15 is bent by a kink 18 in the main surface 19 toward the flank 13 of the support shoulder 3. Thus, in its lower position the metal sheet 15 hugs the saddle 2.

Fashioned along the upper edge 10 of the metal sheet 15 are on one hand support sections in collinear relation to each other supporting the inside of the fold as the printed product 1 is being lifted. On the other hand a staggered section 9 lies between the support sections 16 of the upper edge 10, presenting a recess in the metal sheet 15.

As explained with the previous embodiment, as the plate 15 is raised the simultaneously elevated printed product 1 can be gripped in the region of the recess and/or its thickness can be gauged. If there are several lifting plates 5, these comprise recesses situated in various locations in the direction along the support shoulder 3.

| INDEX OF REFERENCE SYMBOLS | |
|---|---|
| 1 | printed product |
| 2 | saddle |
| 3 | support shoulder |
| 4 | bender |
| 5 | lifting device |
| 6, 6' | parallel guide |
| 7 | roller |
| 7' | frame end |
| 8 | resetting spring |
| 9 | staggering of the upper edge |
| 10 | upper edge |
| 11 | gripper |
| 12, 12' | sheets |

-continued

| INDEX OF REFERENCE SYMBOLS | |
|---|---|
| 13 | leading support flank |
| 14 | trailing support flank |
| 15 | metal sheet |
| 16 | support section |
| 17 | support surface |
| 18 | kink |
| 19 | main surface |
| 20, 20' | parallel guide |
| 21 . . . 26 | first to sixth section |
| 27 | support |
| F | conveying direction |
| B | moving direction of the lifting device |

The invention claimed is:

1. An installation for the lifting of folded printed products (1) from a conveyor, in which conveyor the printed products (1) are transported straddled across a saddle (2), wherein the saddle (2) comprises a counter tool (4) for processing of printed products (1) straddled across the saddle (2), and that a means of lifting (5) extends alongside and parallel to the saddle (2) and is staggered at right angles to a support shoulder (3) of the saddle (2) as well as to the counter tool (4), wherein the means of lifting (5) is a flat or bent plate (15), wherein the edges on one side of the plate (15) form the upper edge (10) of the means of lifting (5), and wherein the upper edge (10) of the means of lifting (5) comprises support sections (16) extending parallel to the support shoulder (3) and situated in collinear relation to each other, and the upper edge (10) comprises a staggered section (9).

2. The installation according to claim 1 wherein the means of lifting (5) can be moved by a control element (7, 7') in order to lift the printed product (1), advantageously against one or several resetting springs (8). ,

3. A method for the operation of the installation according to claim 1, comprising the following steps:

at least one of gathering or transportation of a printed product (1) on the support shoulder (3) of the saddle (2), lifting of the printed product (1) from the support shoulder (3) by the means of lifting (5), gripping of the printed product (1) by a means of clamping; and the following steps, at least one of gathering or transportation of a printed product (1) on the means of lifting (5) in the elevated condition, lowering of the printed product (1) on to the support shoulder (3) and binding of the printed product (1), and measuring a thickness of the printed product (1) by the thickness gauge; and optionally lowering of the printed product (1) on to the support shoulder (3) by the means of lifting (5).

4. The method according to claim 3, wherein the means of clamping is a gripper (11) and the method comprises the additional step of:

discharging of the printed product (1) by the gripper (11).

5. The installation according to claim 1, wherein the support shoulder (3) extends without clearances for a means of lifting along the entire length of the saddle (2).

6. The installation according to claim 1, wherein the counter tool (4) is a bending device (4) for a binding installation.

7. The installation according to claim 1, wherein an upper edge (10) of the means of lifting (5) runs in first regions (16; 22, 25) parallel to the support shoulder (3), wherein the printed product (1) is supported by these first regions as it is lifted, and the upper edge (10) comprises at least in a second region an offset in relation to the first regions.

8. A method for the operation of the installation according to claim 1, comprising the following steps:

at least one of gathering and transporting a printed product (1) on the support shoulder (3) of the saddle (2), lifting the printed product (1) from the support shoulder (3) by the means of lifting (5), gripping of the printed product (1) by a means of clamping; and measuring a thickness of the printed product (1) by the thickness gauge; and optionally lowering the printed product (1) onto the support shoulder (3) by the means of lifting (5).

9. A method for the operation of the installation according to claim 1, comprising the following steps:

at least one of gathering and transporting of a printed product (1) on the means of lifting (5) in the elevated condition, lowering the printed product (1) onto the support shoulder (3) and binding the printed product (1), and measuring a thickness of the printed product (1) by the thickness gauge; and optionally lowering the printed product (1) onto the support shoulder (3) by the means of lifting (5).

10. An installation for the lifting of folded printed products (1) from a conveyor, in which conveyor the printed products (1) are transported straddled across a saddle (2), wherein the saddle (2) comprises a counter tool (4) for processing of printed products (1) straddled across the saddle (2), and that a means of lifting (5) extends alongside and parallel to the saddle (2) and is staggered at right angles to a support shoulder (3) of the saddle (2) as well as to the counter tool (4), wherein the means of lifting (5) is a flat or bent plate (15), wherein the edges on one side of the plate (15) form the upper edge (10) of the means of lifting (5), and wherein the upper edge (10) is shaped on a support surface (17), the support surface (17) is connected to a main surface (19) of the means of lifting (5) via a kink (18), and the support surface (17), in a lowered condition of the means of lifting (5), hugs a flank (13, 14) of the support shoulder (3).

11. The installation according to claim 10, wherein an upper edge (10) of the means of lifting (5) extends parallel to the support shoulder (3) along the entire length of the upper edge (10).

12. An installation for the lifting of folded printed products (1) from a conveyor, in which conveyor the printed products (1) are transported straddled across a saddle (2), wherein the saddle (2) comprises a counter tool (4) for processing of printed products (1) straddled across the saddle (2), and that a means of lifting (5) extends alongside and parallel to the saddle (2) and is staggered at right angles to a support shoulder (3) of the saddle (2) as well as to the counter tool (4), wherein an upper edge (10) of the means of lifting (5) extends parallel to the support shoulder (3) along the entire length of the upper edge (10), and wherein the means of lifting (5) is a wire frame.

13. The installation according to claim 12, wherein the wire frame comprises:

a first section (21) and a sixth section (26), each extending vertically to the support shoulder (3) and transferable in an allocated parallel guide (6, 6'), a second section (22) and a fifth section (25), each extending parallel to the support shoulder (3) and situated in collinear relation to each other, a staggered section (9), extending parallel to the support shoulder (3) and staggered from the second (22) and fifth section (25), and a third section (23) between the second section (22) and the staggered section (9) as well as a fourth section (24) between the staggered section (9) and the fifth section (25).

14. An installation for the lifting of folded printed products (1) from a conveyor, in which conveyor the printed products (1) are transported straddled across a saddle (2), wherein the saddle (2) comprises a counter tool (4) for processing of printed products (1) straddled across the saddle (2), and that a means of lifting (5) extends alongside and parallel to the saddle (2) and is staggered at right angles to a support shoulder (3) of the saddle (2) as well as to the counter tool (4), wherein the installation comprises two means of lifting (5), wherein the first means of lifting (5) is situated on a leading side of the saddle (2) and the second means of lifting (5) on a trailing side of the saddle (2), and wherein upper edges (10) of both means of lifting (5) are differently shaped and in particular comprise in one or several places an offset (9) in varying regions along the support shoulder (3).

* * * * *